United States Patent [19]

Nagata et al.

[11] Patent Number: 4,614,263

[45] Date of Patent: Sep. 30, 1986

[54] CIGARETTE ARRANGING APPARATUS

[75] Inventors: Tomizou Nagata; Kazutaka Kobayashi, both of Tokyo, Japan

[73] Assignee: Japan Tobacco, Inc., Japan

[21] Appl. No.: 647,904

[22] Filed: Sep. 6, 1984

[30] Foreign Application Priority Data

Sep. 13, 1983 [JP] Japan ..... 58-167582

[51] Int. Cl.[4] ..... B65G 47/26

[52] U.S. Cl. ..... 198/419; 53/151; 131/282; 198/420; 198/471.1; 198/476.1

[58] Field of Search ..... 198/419, 420, 689, 478, 198/450, 471.1, 476.1; 53/148, 149, 150, 151; 131/282, 283

[56] References Cited

FOREIGN PATENT DOCUMENTS

| | | | |
|---|---|---|---|
| 2327916 | 12/1973 | Fed. Rep. of Germany | 53/151 |
| 47-8600 | 3/1972 | Japan . | |
| 1168447 | 10/1969 | United Kingdom | 53/151 |
| 2034577 | 6/1980 | United Kingdom | 131/282 |

*Primary Examiner*—Joseph E. Valenza

*Assistant Examiner*—Kyle E. Shane

*Attorney, Agent, or Firm*—Lowe, Price, Leblanc, Becker & Shur

[57] ABSTRACT

A cigarette arranging apparatus is disclosed. It has an arranging drum including a plurality of arcuate grooves arranged in its periphery, the grooves being extended in the axial direction and intimately contacted each other in the circumferential direction, and a plurality of cigarette receiving rollers near to the upper outer periphery of the arranging drum. The number of the cigarette receiving rollers corresponds to that of the arcuate grooves. The cigarette receiving rollers are arranged each to receive one piece of cigarette out of the plurality of cigarette pieces. The arranging drum and the cigarette receiving rollers are rotated in the opposite directions each other. The rollers are arranged to send cigarette pieces into the grooves successively from the forward grooves till the backward grooves without changing the motion speed to arrange cigarette groups intimately contacted each other. There is also disclosed a cigarette arranging apparatus including three arranging drums with respect to a stacking drum.

16 Claims, 14 Drawing Figures

CIGARETTE ARRANGING APPARATUS

BACKGROUND OF THE INVENTION

The present invention relates to an apparatus for arranging groups of a predetermined number of cigarettes which are to be delivered to a stacking device, in a process prior to the process for piling up cigarettes in plural layers having honeycomb patterns in order to enclose cigarettes in a package.

As known, cigarettes are enclosed in a package in the piled-up state to form honeycomb patterns, for example, 7 pieces for the bottom, 6 pieces for the intermediate and 7 pieces for the top. In this case, unless the cigarettes are continuously arranged in a constant pitch for each layer and in an intimately contacting manner with respect to each other, a stable pile of cigarettes cannot be obtained. Thus, it is required to arrange cigarette groups in a constant pitch which are to be sent into a stacking device.

In the prior art, the arrangement of cigarettes is conducted as disclosed in, for example, Japanese Patent Application Post-Examination Publication No. 47(1972)-8600 and Japanese Patent Application Early Publication No. 57(1982)-198082, wherein a drum is formed of a plurality of grooves extending in the axial direction and connecting in a consecutive manner in the circumferential direction on the periphery thereof, and said plurality of grooves receive therein a piece of cigarette per one groove and then send it out, so that a group of a predetermined number of cigarette pieces in a constant pitch state are prepared. However, in the prior art, when a piece of cigarette is delivered into one of said arcuate supporting grooves on the arranging drum, the cigarettes supplied in a single row are obliged to be subjected to a pressing treatment in order to form continuous cigarette groups for transmitting into the arcuate supporting grooves in a consecutive manner by sending out the foremost end cigarette first. In this case, when the cigarettes which were supplied in a discontinuous manner and in a single row are formed into continuous cigarette groups, the force of impact is applied to the respective cigarettes which results in damage, deformation, etc. of the cigarettes. Furthermore, the cigarette groups under pressure render differences in pitch for each cigarette, because the filling amount of cigarette leaves is different for each cigarette. As a result, a pitch difference arises between the delivering side and the receiving side, which often creates such trouble as biting, etc. when the cigarettes are transferred from one drum to the other. Thus, the productivity is decreased. Furthermore, since the supply passage of the cigarettes is formed in a single row, the supply amount of the cigarettes is limited, thus rendering a bar for a high speed operation of the apparatus.

SUMMARY OF THE INVENTION

It is therefore an object of the present invention to provide a cigarette arranging apparatus, wherein a plural number of receiving rollers corresponding to the predetermined number of cigarette pieces arranged on an arranging drum are provided along the outer periphery of said arranging drum, so that constant delivery of the cigarette pieces can be obtained without fail.

Another object of the invention is to provide a cigarette arranging apparatus, wherein arcuate supporting grooves are formed on the arranging drum for receiving the cigarette pieces supplied one after another from each of the receiving rollers.

A further object of the invention is to provide a cigarette arranging apparatus, wherein cigarette pieces can be delivered from the receiving rollers to the arranging drum without changing the motion speed, i.e., the sending out and receiving speeds are in accord with respect to each other, so that cigarette pieces can be arranged in a continuous manner as well as in a constant pitch.

Still a further object of the present invention is to provide a cigarette arranging apparatus, wherein cigarette pieces are prevented from getting damaged or deformed in the process of arrangement.

An even further object of the invention is to provide a cigarette arranging apparatus, wherein cigarette pieces are supplied through plural passages so that arrangement can be effected at a high speed.

Another important object of the present invention is to provide a cigarette arranging apparatus, wherein a plurality of arranging drums are provided around a stacking drum and the arranging drums and the stacking drum are rotated in the opposite directions, so that cigarette groups can be delivered one after another to the stacking drum without changing the motion speed.

A further object of the invention is to provide a cigarette arranging apparatus, wherein orderly piling up of cigarette pieces in several layers can be achieved in such honeycomb pattern.

In order to achieve the above objects and others, there is essentially provided a cigarette arranging apparatus comprising an arranging drum including a plurality of arcuate grooves arranged at the periphery thereof, said grooves being extended in the axial direction and intimately contacted with respect to each other in the circumferential direction, and a plurality of cigarette receiving rollers provided in close vicinity of the upper outer periphery of said arranging drum, said cigarette receiving rollers corresponding in number to that of said arcuate grooves, said cigarette receiving rollers being arranged each to receive one piece of cigarette out of said plurality of cigarettes, said arranging drum and said cigarette receiving rollers being rotated in the reversed directions, said plurality of cigarette receiving rollers being arranged to send cigarette pieces into said plurality of arcuate supporting grooves successively from the forward grooves till the backward grooves without changing the motion speed thereof, so that intimately contacted cigarette groups are arranged with respect to each other.

There is also essentially provided a cigarette arranging apparatus comprising a stacking device including a stacking drum, and a plurality of arranging drums provided in the close vicinity of the upper outer periphery of said stacking drum and adapted to serve for sending cigarette groups into said stacking drum. The peripheral speeds of said receiving rollers, arranging drums and stacking drum are all in accord with respect to each other.

DETAILED DESCRIPTION OF THE EMBODIMENT

Figure 1:
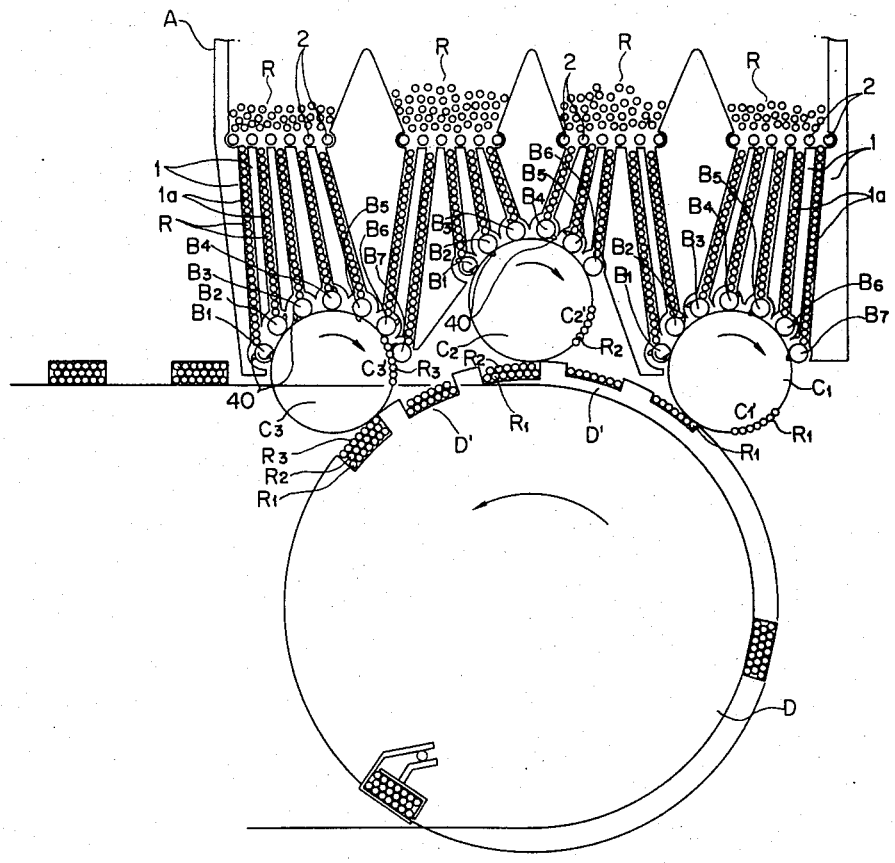
FIG. 1 is a schematic view showing the overall cigarette stacking apparatus to which the present invention is applied.
Figure 2:
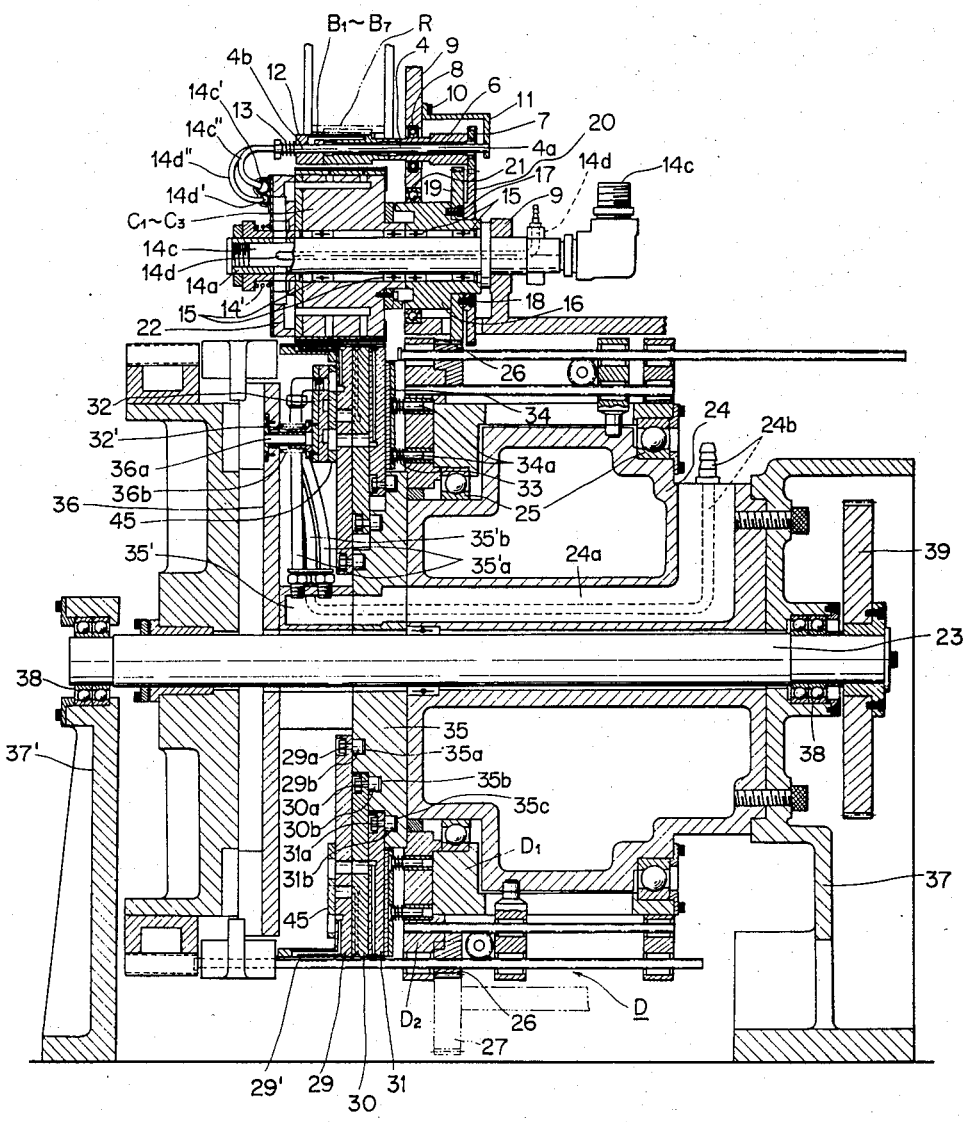
FIG. 2 is a sectional view showing the concrete constitution of the above.
Figure 4:
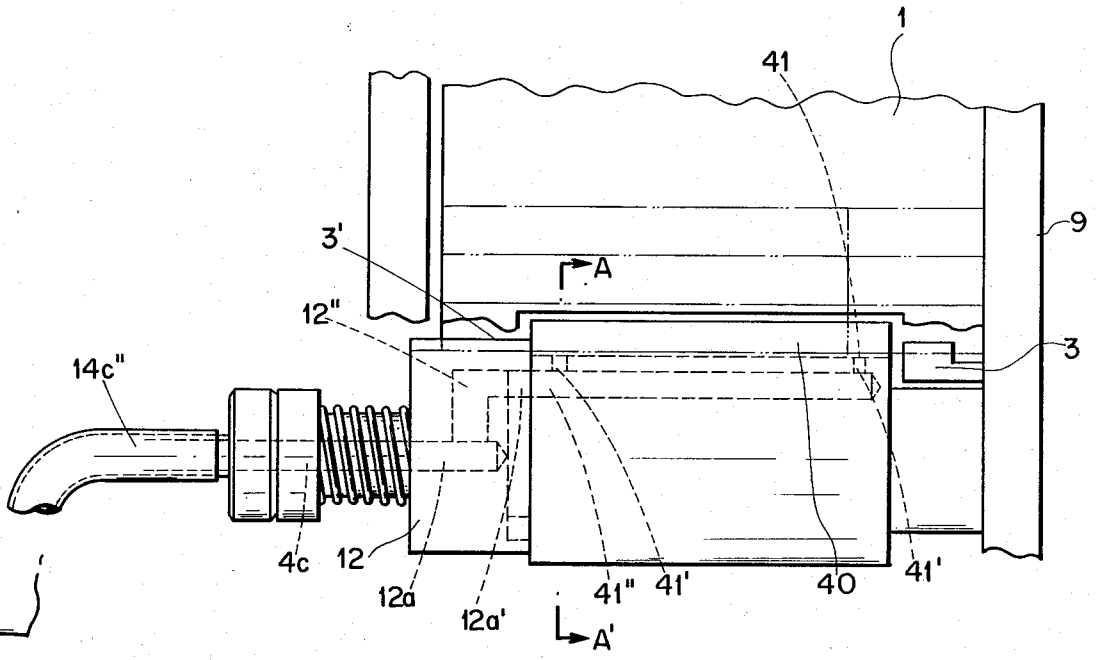
FIG. 4 is a side view showing the cigarette receiving roller portion.
Figure 3:
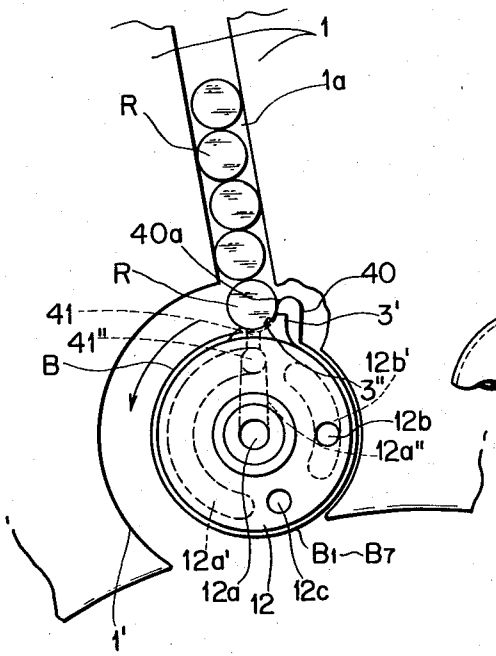
FIG. 3 is a front view showing a cigarette receiving roller portion.
Figure 5:
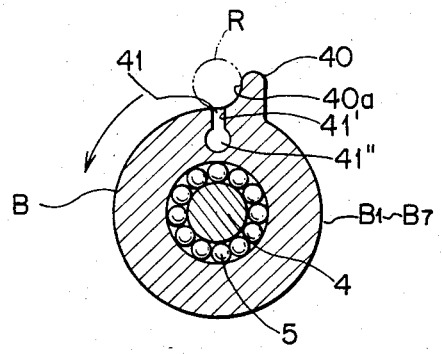
FIG. 5 is a sectional view of the cigarette receiving roller taken on line A–A' of FIG. 4.
Figure 9:
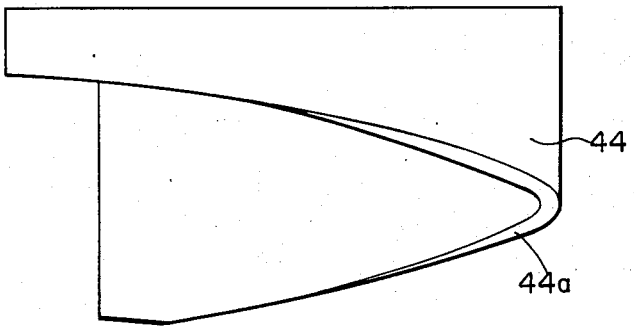
FIG. 9 is a plan view showing a cigarette transferring guide.
Figure 10:
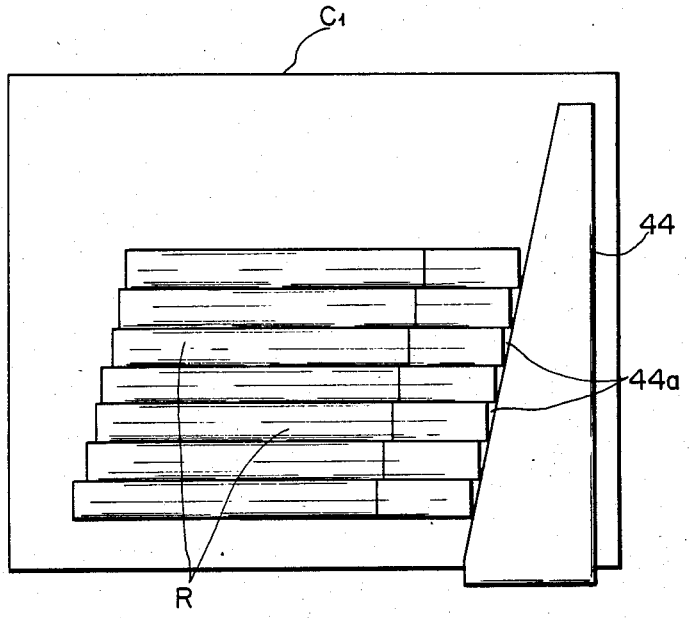
FIG. 10 is a schematic view showing the cigarette transferring guide when in use.
Figure 6:
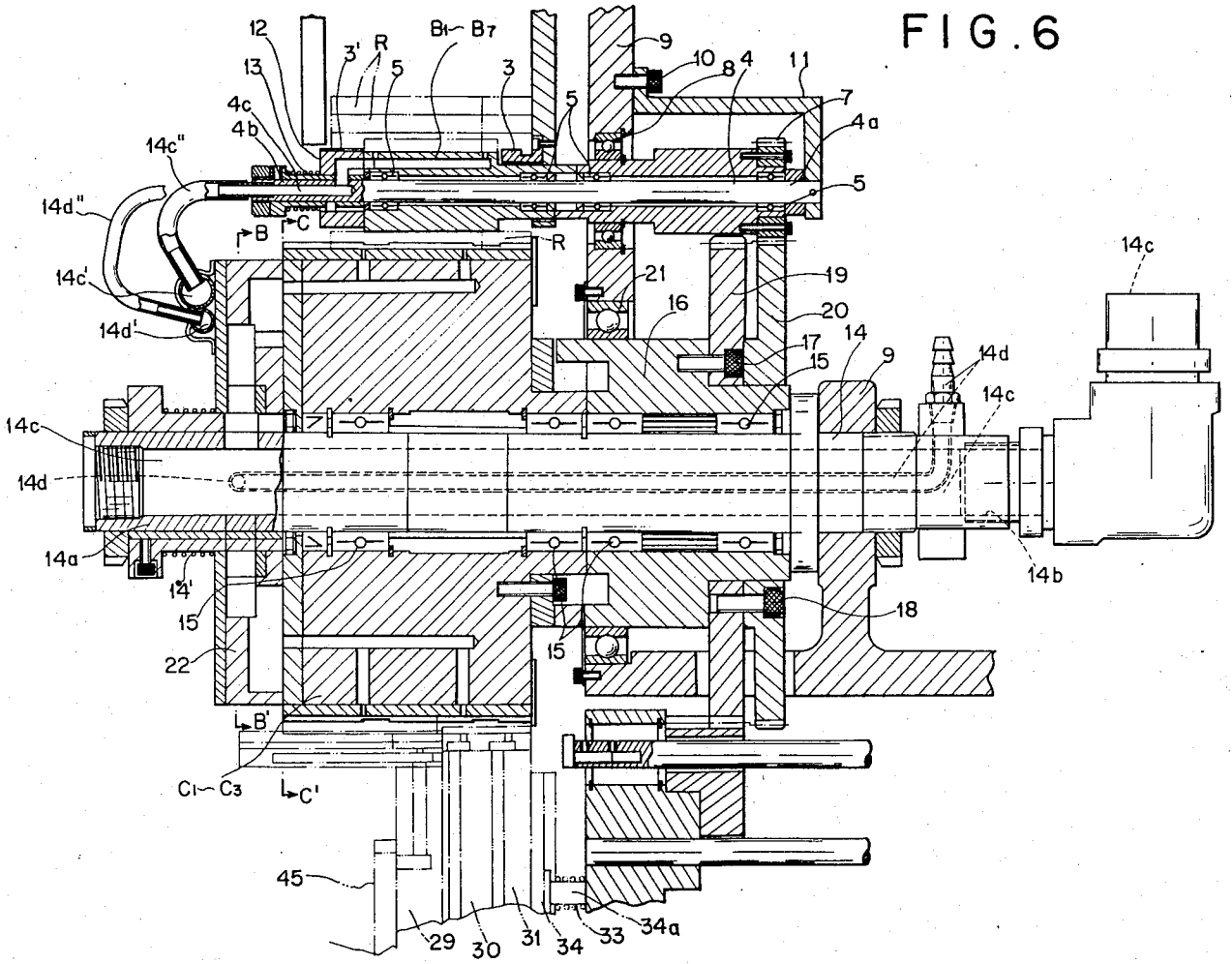
FIG. 6 is an enlarged sectional view of the receiving roller and arranging roller.
Figure 7:
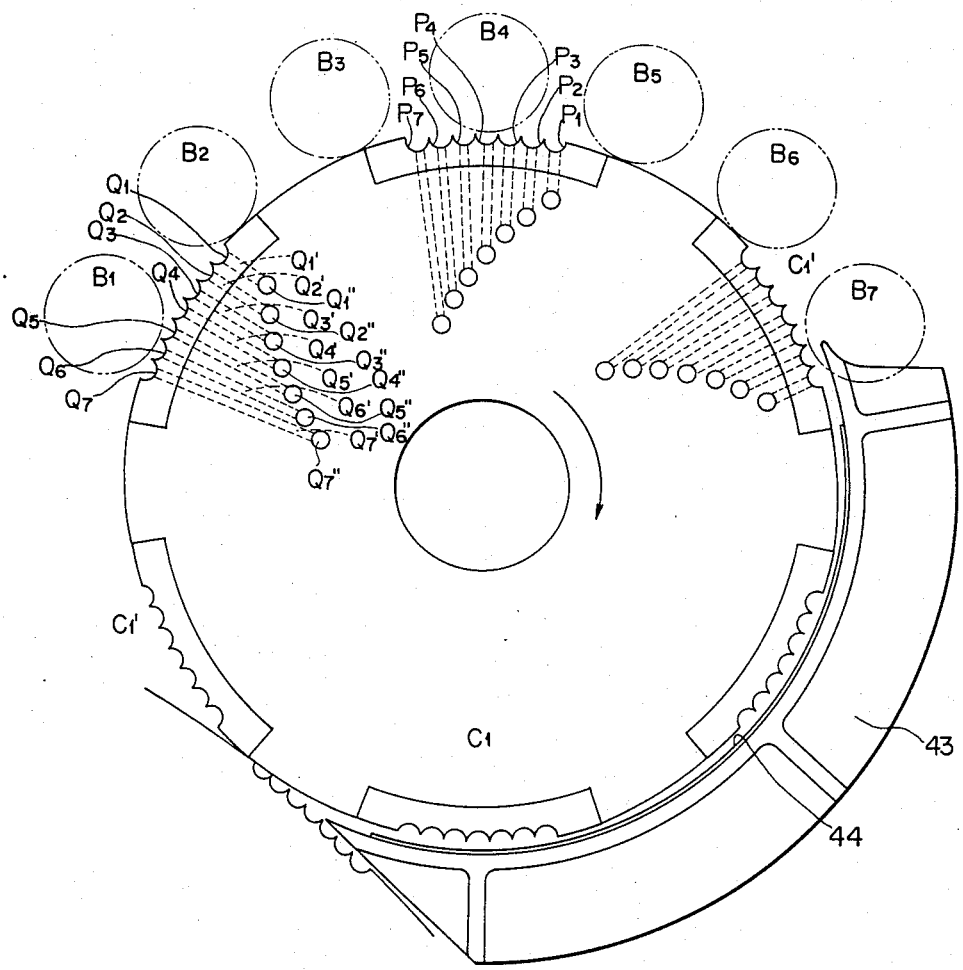
FIG. 7 is a sectional view taken on line C–C' of FIG. 6.
Figure 8:
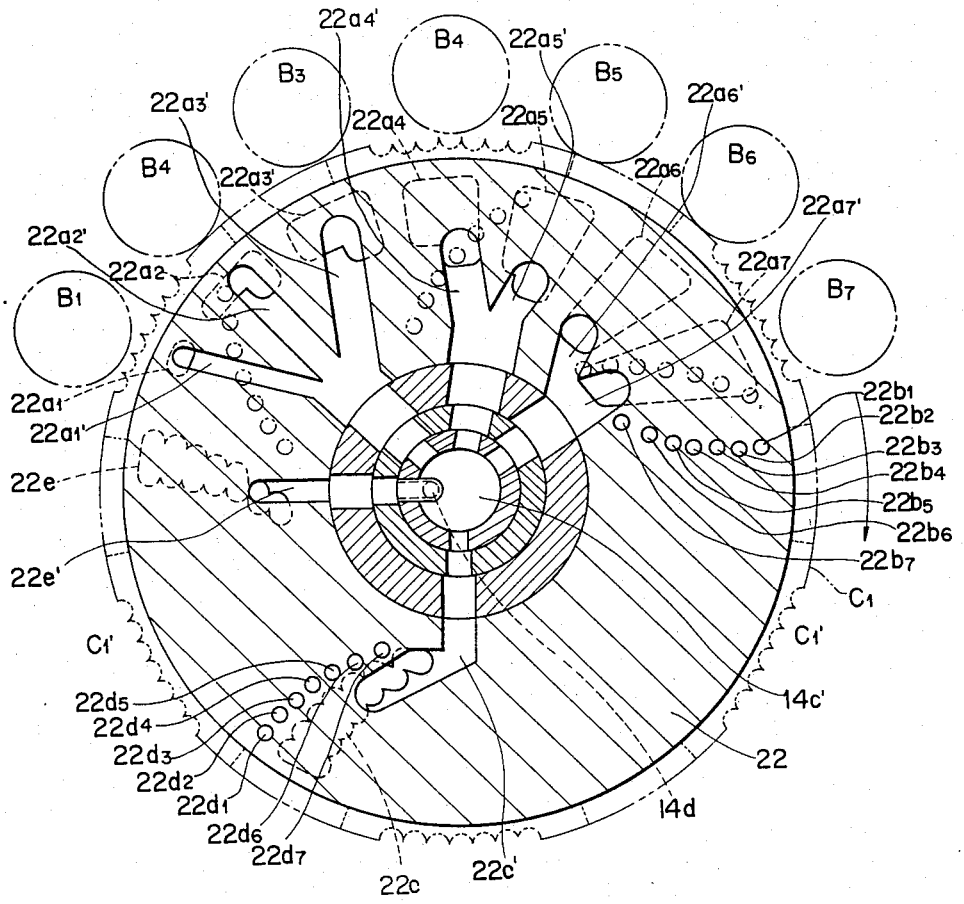
FIG. 8 is a sectional view of an air controlling ring taken on line B–B' of FIG. 6.
Figure 11:
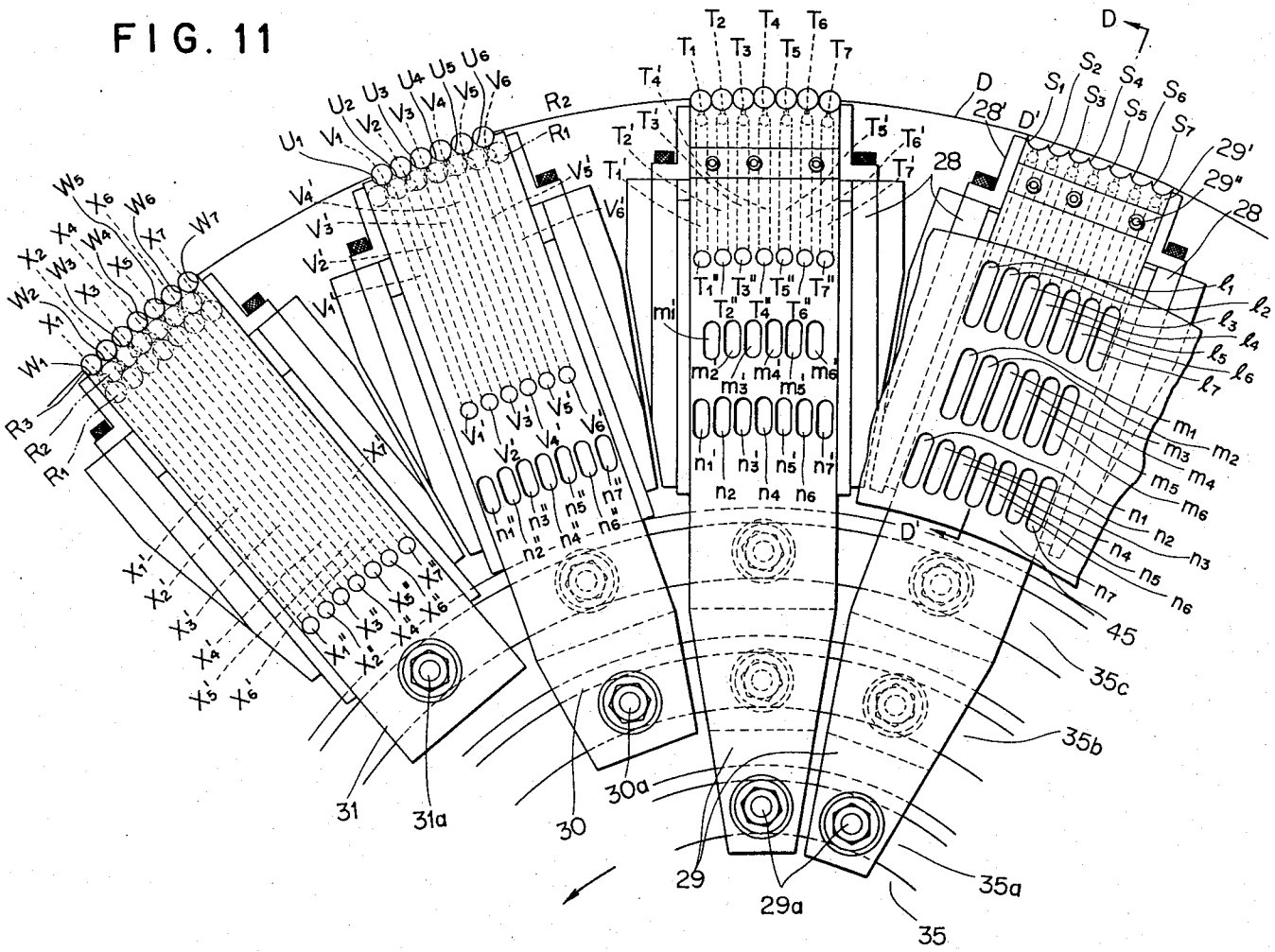
FIG. 11 is a front view of a plurality of receiving suction plates in the stacking drum, showing an air passage regulating plate from the right side to the left side in order as well as a bottom row receiving suction plate in its position preparing to receive cigarettes, a bottom row receiving suction plate in its state ready to receive cigarette pieces, an intermediate row receiving suction plate in its state ready to receive cigarette pieces, and a top row receiving suction plate in its state ready to receive cigarette pieces.
Figure 12:
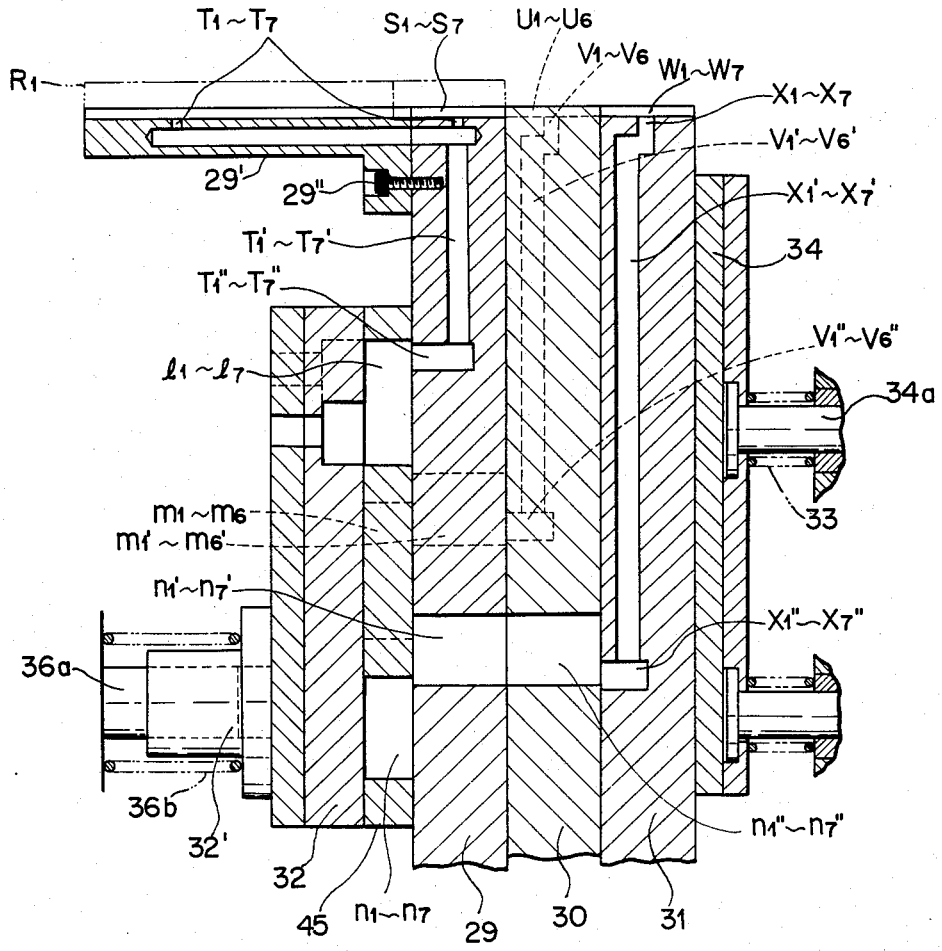
FIG. 12 is a sectional view of the bottom row cigarette receiving position in the stacking portion taken on line D–D' of FIG. 11.
Figure 13:
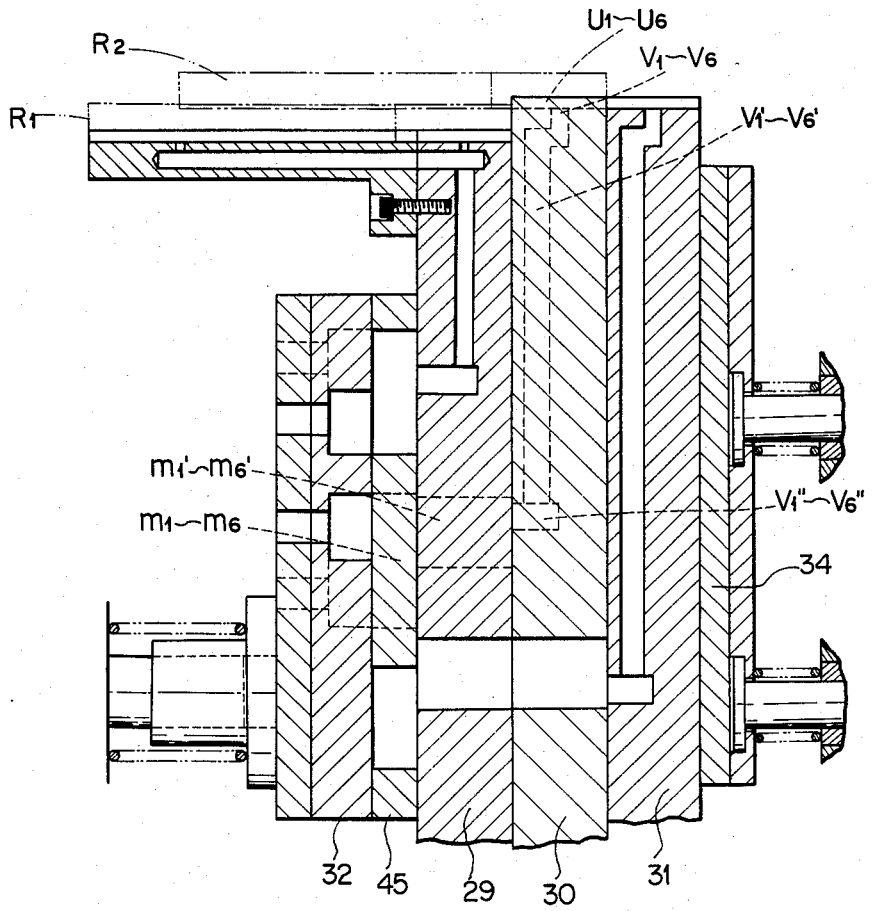
FIG. 13 is a sectional view of the above in its intermediate row cigarette receiving position taken on line D–D' of FIG. 11.
Figure 14:
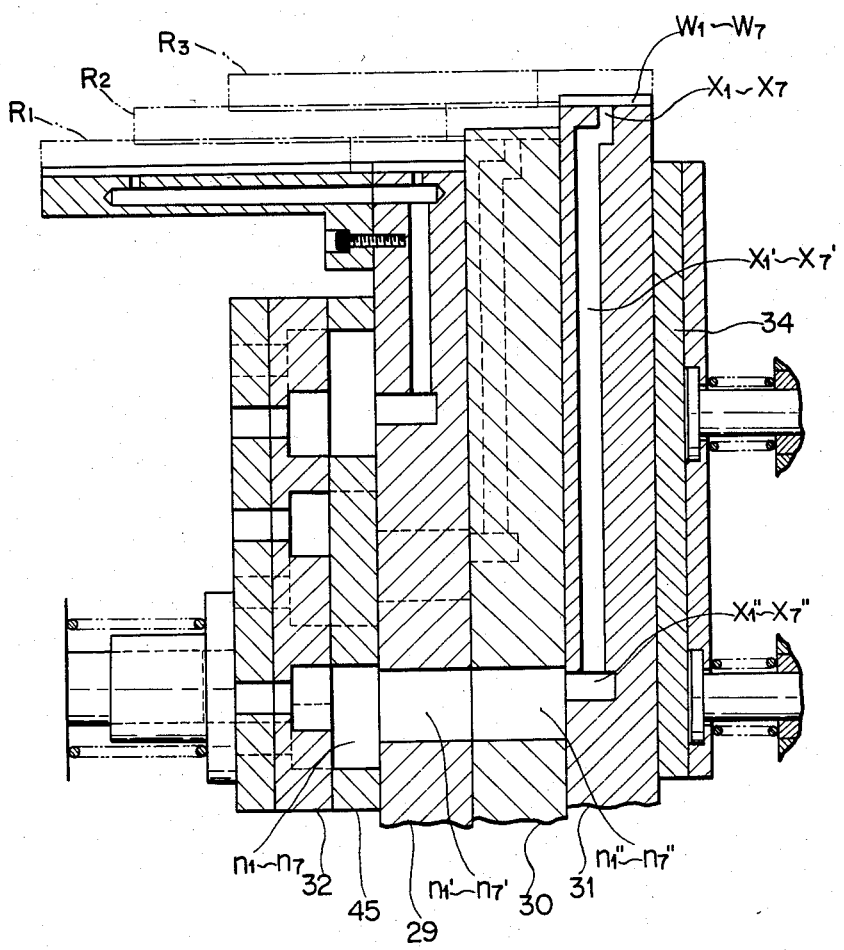
FIG. 14 is a sectional view of the above in its top row cigarette receiving position on line D–D' of FIG. 11.

Preferred embodiments of the present invention will be described hereunder with reference to the accompanying drawings.

A denotes a cigarette hopper; $B_1$ through $B_7$ denote receiving rollers each for receiving a piece of cigarette; $C_1$, $C_2$ and $C_3$ denote cigarette arranging drums; and D denotes a cigarette stacking drum. In the close vicinity of the stacking drum D at its upper outer periphery are provided an arranging drum $C_1$ for 7 pieces of cigarette, an arranging drum $C_2$ for 6 pieces of cigarette, and an arranging drum $C_3$ for 7 pieces of cigarette. In the close vicinity of each of said arranging drums $C_1$, $C_2$ and $C_3$at its upper outer periphery, are provided 7 pieces or 6 pieces of cigarette receiving rollers $B_1$ through $B_7$, $B_1$ through $B_6$ corresponding to the number of cigarettes to be arranged. From the lower portion of the hopper A, partition panels 1 are provided for forming cigarette dropping passages 1*a* reaching to 20 pieces in total of the receiving rollers $B_1$ through $B_7$, $B_1$ through $B_6$, $B_1$ through $B_7$ on each of the arranging rollers $C_1$, $C_2$ and $C_3$. Agitator rollers 2 are rotatably provided at the upper ends of said partition panels 1 in the hopper A in order to send cigarette pieces into the passages 1*a* smoothly.

The respective rollers $B_1$ through $B_7$, $B_1$ through $B_6$ and $B_1$ through $B_7$ are rotated counter-clockwise to send 7 pieces or 6 pieces of cigarette into the arranging drums $C_1$, $C_2$, $C_3$ rotating clockwise in such a manner as to accord the sending and receiving speed with respect to each other, so that the cigarette pieces are arranged in an intimately contacted state with respect to each other. The arranging drums $C_1$ and $C_3$ include 6 pieces of arranging portion equally divided by 6, while the arranging drum $C_2$ includes 5 pieces of arranging portion equally divided by 5. The arranging drum $C_1$ supplies 7 pieces of cigarette group $R_1$ in the bottom row to respective stacking portions D' provided at equally divided positions by 18 of a stacking drum D, said stacking drum D being rotated counter-clockwise. Likewise, the arranging drums $C_2$, $C_3$ supply cigarette groups $R_2$, $R_3$, i.e., 6 pieces of the intermediate row and 7 pieces of the top row, to the respective stacking portions D'. In the foregoing, the receiving rollers $B_1$ through $B_7$, arranging drums $C_1$, $C_2$, $C_3$ and the stacking drum D are constituted such that the peripheral speed at the rolling cores of the supporting cigarette pieces are all in accord with respect to each other.

The receiving roller B is rotatably mounted on a rigid shaft 4 through a bearing 5. The rigid shaft 4 is provided with a rotary transmitting member 6 likewise through the bearing 5, said rotary transmitting member 6 being engaged at its end with the receiving rollers $B_1$ through $B_7$. At the other end of said rotary transmitting member 6 is provided a gear 7. Said rotary transmitting member 6 is supported by a frame 9 through a bearing 8. Said frame 9 is fixed with a subframe 11 by a screw 10 and said subframe 11 is fixed with one end 4*a* of the rigid shaft 4. At the other end 4*b* of the rigid shaft 4 is slidably mounted in the axial direction an air control ring 12 which is urgedly contacted to the outsides of the receiving rollers $B_1$ through $B_7$ by a coil spring 13.

The arranging drum C is rotatably mounted on the rigid shaft 14 through a bearing 15. Said rigid shaft 14 is provided with a rotary transmitting member 16 likewise through a bearing 15, said member 16 being engaged at its one end with the arranging drums $C_1$ through $C_3$. At the other end of said rotary transmitting member 16 are juxtaposed gears 19, 20 through screws 17, 18. The rotary member 16 is supported by the frame 9 through a bearing 21. This means that a part of the rigid shaft 14 is indirectly supported by the frame 9, and at the same time, the other portion of the rigid shaft 14 is directly supported by the frame 9. At one end 14*a* of the rigid shaft 14 is slidably provided an air control ring 22 which is urgedly contacted to a side face of the arranging drum C by a coil spring 14'. At the other end 14*b* of the rigid shaft 14 is opened up a vacuum suction passage 14*c* within which a pressurized air supply pipe 14*d* is provided. Said vacuum suction passage 14*c* and said pressurized air supply pipe 14*d* are communicated with the air control ring 22.

The stacking drum D is comprised of a cylindrical portion $D_1$ and an annular plate portion $D_2$, and is rotatably provided with respect to an annular rigid member 24 through a bearing 25. At the side portion of the stacking drum D is provided a large gear 26 which meshes with an input gear 27 for rotating the stacking drum D, when the power is transmitted. The arranging drum C is rotated by means of the engagement of the large gear 26 and the gear 19. Furthermore, the gear 20 juxtaposed with the gear 19 is meshed with the gear 7 to transmit the power to the roller B.

On one side of the stacking drum D, a pair of L-shaped slide guide members 28 are fixedly secured to the annular plate portion $D_2$ at its equally divided position by 18 in such a manner as to form an accommodation pocket toward the radial direction from the center thereof. Within said slide guide member 28, there are provided a bottom row cigarette receiving suction plate 29, an intermediate row cigarette receiving suction plate 30 and a top row cigarette receiving suction plate 31 to which cigarettes are supplied from the arranging drum C, in such a manner as to be overlapped in the axial direction and at the same time, independently slidable with respect to each other in the radial direction. At the end of the outer periphery of the slide guide member 28 is fixed a supporting metal 28' to form a cigarette accommodation pocket with its both ends opened in the axial direction.

Said pair of slide guide members 28 are fixed with an air passage regulating plate 45 at the open ends thereof. Said air passage regulating plate 45 is slidingly contacted to the bottom row cigarette receiving suction plate 29 at its outer face. A presser plate 34 biased by a spring 33 and through a supporting shaft 34*a* is abutted against the top row cigarette receiving suction plate 31, so that the respective receiving suction plates 29, 30, 31 are pressed against the air passage regulating plate 45 while maintaining the intimate contact among the suction plates 29, 30, 31.

The respective receiving suction plates 29, 30, 31 are provided with cam followers 29*b*, 30*b*, 31*b* by pins 29*a*, 30*a*, 31*a*, said cam followers 29*b*, 30*b*, 31*b* being engaged with cam grooves 35*a*, 35*b*, 35*c* of a cam 35 fixed at one side of said annular rigid member 24. Within said annular rigid member 24, a vacuum suction passage 24*a* is provided and at the same time, a pressurized air supply pipe 24*b* is provided in a biased position with respect to the circumferential direction. Said vacuum suction passage 24*a* and pressurized air supply pipe 24*b* are communicated with a fan-shaped air groove 35' fixed to the side of the cam 35 for supplying a vacuum suction as well as a pressurized air to the air control ring 32 through pipes 35'*a*, 35'*b*. The air control ring 32 is slidably mounted on a shaft 36*a* through a slide metal 32', and urgedly contacted to the air passage regulating plate 45 by a spring 36*b*, said shaft 36*a* being fixed by using a supporting plate 36 for a compression device in the succeeding process which is not directly related to the present invention.

The central rotary shaft 23 is supported by bearing stands 37 and 37' through a bearing 38, and inputted through a gear 39 mounted on one end thereof. Since the members rotated by the shaft 23 are not directly related to the present invention, description thereof will be eliminated.

At the lower portion of the cigarette dropping passage 1*a* defined by the partition panel 1, a pair of cigarette supporting members 3, 3' are provided on both sides of the receiving rollers $B_1$ through $B_7$ with respect to the axial direction thereof. The supporting member 3 is provided at the side portion of the frame 9, while the supporting member 3' is provided as an protruded portion on the outer periphery of the air control ring 12. The cigarette supporting members 3, 3' include an arcuate supporting plate 3'' opened up at the rotating direction side of the receiving rollers $B_1$ through $B_7$. The bottom portion of said arcuate supporting plate 3'' is formed slightly higher than the outer periphery B of the receiving rollers $B_1$ through $B_7$, thus leaving a space between the supporting cigarette piece R and the receiving rollers $B_1$ through $B_7$ in order to minimize the vibration of the cigarette piece R for avoiding the end face of the cigarette piece from getting damaged.

A cigarette transfer knob 40 including an arcuate abutting plane 40*a* is provided on the outer peripheral portion of the receiving rollers $B_1$ through $B_7$. A suction mouth 41 is opened up in front of the cigarette transfer knob 40 on the outer peripheral portion of the receiving rollers $B_1$ through $B_7$. Said suction mouth 41 is also opened up in the side face of the receiving rollers $B_1$ through $B_7$ through communication passages 41', 41''.

The respective air control rings 12 slidingly contacted with the receiving rollers $B_1$ through $B_7$ are formed with a vacuum suction mouth 12*a*, a pressurized air supply mouth 12*b* and an atmospheric communication mouth 12*c*. The vacuum suction mouth 12*a* is connected to a common pipe 14*c'* provided on the outer side face of the air control ring 22 of the arranging drum C by a pipe 14*c''* through a communication hole 4*c* of the rigid shaft. The pressurized air is connected to the pressurized air supply mouth 12*b* of the common air control ring 12 provided in the outer side face of the air control ring 22.

The vacuum suction mouth 12*a* is communicated with arcuate groove 12*a'* defined in the range from the lower portion of the supporting member 3 to the vicinity of the arranging drum C through a communication passage 12''. The pressurized air supply mouth 12*b* is communicated with an arcuate groove 12*b'* of a comparatively limited range.

Consequently, after dropping through the passage 1*a*, the cigarette pieces R are supported by the supporting members 3, 3' and sent out forwardly by the transmitting knob 40, while the receiving rollers $B_1$ and $B_7$ are rotated, and at the same time, the cigarette pieces R are transferred in the absorbed state by means of the vacuum suction mouth 41. At the end portion of the arcuate groove 12*a'*, the cigarette pieces R are relieved from the absorption by means of the atmospheric communication mouth 12*c* and sent into the arranging drums $C_1$, $C_2$ and $C_3$. The communication passages 41', 41'', leading to the vacuum suction mouth 41 are swept and cleaned by the pressurized air supplied from the pressurized air supply mouth 12*b*. A guide portion 1' is provided along the outer peripheral portion of the receiving rollers $B_1$ through $B_7$, said guide portion 1' being formed by extending the lower end of the partition panel 1.

In the cigarette arranging drum $C_1$, an arranging portion $C_1'$ is provided at one sixth position of the outer periphery of the drum. Said arranging portion $C_1'$ is provided with a continuous 7 pieces of arcuate supporting grooves $P_1$, $P_2$, $P_3$, $P_4$, $P_5$, $P_6$ and $P_7$ extending in the axial direction and intimately contacted with respect to each other in the circumferential direction of the arranging drum $C_1$. In the respective arcuate supplying grooves $P_1$ through $P_7$ are opened up vacuum suction mouths $Q_l$, $Q_2$, $Q_3$, $Q_4$, $Q_5$, $Q_6$ and $Q_7$ which are communicated with openings $Q_1''$, $Q_2''$, $Q_3''$, $Q_4''$, $Q_5''$, $Q_6''$ and $Q_7''$, respectively, on the side of the arranging drum $C_1$ through communication passages $Q_1'$, $Q_2'$, $Q_3'$, $Q_4'$, $Q_5'$, $Q_6'$ and $Q_7'$ which are increasingly longer toward the axial center.

The air control ring 22 for the arranging drum $C_1$ is provided in its upper half portion with vacuum suction grooves $22a_1$, $22a_2$, $22a_3$, $22a_4$, $22a_5$, $22a_6$ and $22a_7$ which are divided in blocks and increasingly larger in dimension as if they are in accord with the above-mentioned openings $Q_1''$, $Q_2''$, $Q_4''$, $Q_5''$, $Q_6''$ and $Q_7''$. Said vacuum suction grooves $22a_1$ through $22a_7$ are communicated with the central vacuum suction passage 14*c* through communication passages $22a_1'$, $22a_2'$, $22a_3'$, $22a_4'$, $22a_5'$, $22a_6'$ and $22a_7'$.

In the close vicinity of the last vacuum suction groove $22a_7$ in the foregoing, 7 pieces of atmospheric communication mouths $22b_1$, $22b_2$, $22b_3$, $22b_4$, $22b_5$, $22b_6$ and $22b_7$ are provided in order to break the vacuum.

In the lower portion of the air control ring 22, a continuous vacuum suction groove 22c of a limited small range is provided at the portion where the respective arranging portions $C_1'$ of the arranging drum $C_1$ are positioned close to the stacking drum D. Said vacuum suction groove 22c is also communicated with the central vacuum suction passage 14c through a communication passage 22c'. Atmospheric communication mouths $22d_1$, $22d_2$, $22d_3$, $22d_4$, $22d_5$, $22d_6$ and $22d_7$ similar to the foregoing are provided in the close vicinity of the vacuum suction groove 22c. Furthermore, a continuous pressurized air supply mouth 22e is provided with a space therebetween and communicated with a pressurized air supply pipe 14d through a communication passage 22e'.

The receiving rollers $B_1$ through $B_7$ are provided in the close vicinity of the portion of the arranging drum $C_1$ corresponding to the 7 pieces of vacuum suction grooves $22a_1$ through $22a_7$ of the air control ring 22. A guide plate 43 is provided in the close vicinity of the outer peripheral portion of the arranging drum $C_1$ from the lower portion of the last receiving roller $B_7$ till the upper portion of the stacking drum D. Within said guide plate 43, a forced transferring guide 44 is provided in the axial direction.

When the arranging drum $C_1$ is rotated clockwise, the cigarette R is sent into the arcuate supporting groove $P_1$ of the respective arranging portions $C_1'$ from the included backward with respect to the rotary direction from the receiving roller $B_1$. At this moment, the vacuum suction mouth $Q_1$ is communicated with the vacuum suction groove $22a_1$ so that the cigarette R is held by the arcuate supporting groove $P_1$ without fail. Nextly, as the arranging drum $C_1$ rotates, the cigarette piece R is sent into and held by the arcuate supporting groove $P_2$ in the intimately contacting state at the peripheral portion from the receiving roller $B_2$. Likewise, cigarette piece R is sent into the corresponding arcuate supporting grooves $P_3$, $P_4$, $P_5$, $P_6$ and $P_7$ from the receiving rollers $B_3$, $B_4$, $B_5$, $B_6$ and $B_7$, so that 7 pieces of cigarette groups $R_1$ are formed on the respective arranging portion $C_1'$ in the intimately contacting state with respect to each other.

After the vacuum suction is resolved, the cigarette groups $R_1$ are abutted against the guide 44 at the tapered driving plane 44a of the guide 44 and forced to transfer in the axial direction. Finally, the cigarette groups $R_1$ are transferred by 40 mm in the axial direction. When the guide 44 is brought to be disengagement with the guide plate 43, the cigarette groups $R_1$ are absorbed again in a moment by means of the vacuum suction groove 22c of the air control ring 22. Then the suction is resolved by the atmospheric communication holes $22d_1$ through $22d_7$ and the cigarette groups $R_1$ are sent into the stacking portion D' of the stacking drum D.

In the arranging drum $C_2$, 6 pieces of cigarette groups $R_2$ intimately contacted each other are formed in the same manner as mentioned above. After forcedly transferred by 20 mm in the axial direction by a rigid plate (not shown), the cigarette groups $R_2$ are sent onto the afore-mentioned cigarette groups $R_1$ in the stacking portion D' of the stacking drum D and piled up on the bottom cigarette groups $R_1$ in the state biased in the axial direction by 20 mm with respect to the cigarette groups $R_1$.

In the arranging drum $C_3$, the cigarette groups $R_3$ are piled up upon the intermediate cigarette group $R_2$ as they are and in the state biased in the axial direction by 20 mm without transferring the cigarette groups $R_3$. The constitution of the arranging drums $C_2$, $C_3$ is basically the same as that of the arranging drum $C_1$.

In the respective stacking portions D' of the stacking drum D, there are provided and urgedly contacted with respect to each other the bottom cigarette receiving suction plate 29 for the 7 pieces of cigarette groups $R_1$, the intermediate cigarette receiving suction plate 30 for the 6 pieces of cigarette groups $R_2$, and the top cigarette receiving suction plate 31 for the 7 pieces of cigarette groups $R_3$.

On the outer end of the bottom cigarette receiving suction plate 29, cigarette receiving member 29' extending in the crossing direction with respect to the moving direction is secured by a screw 29''. From the bottom cigarette receiving suction plate 29 to the cigarette receiving member 29', arcuate supporting grooves $S_1$, $S_2$, $S_3$, $S_4$, $S_5$, $S_6$ and $S_7$ for the 7 pieces of cigarette are provided in the close vicinity thereto. Vacuum suction mouths $T_1$, $T_2$, $T_3$, $T_4$, $T_5$, $T_6$ and $T_7$ are opened up in said arcuate supporting grooves $S_1$ through $S_7$. Said vacuum suction mouths $T_j$ through $T_7$ are communicated with openings $T_1''$, $T_2''$, $T_3''$, $T_4''$, $T_5''$, $T_6''$ and $T_7''$ formed on the side of the bottom cigarette suction plate 29 through the communication passages $T_1'$, $T_2'$, $T_3'$, $T_4'$, $T_5'$, $T_6'$ and $T_7'$.

On the outer end of the intermediate cigarette receiving suction plate 30, arcuate supporting grooves $U_1$, $U_2$, $U_3$, $U_4$, $U_5$ and $U_6$ for the 6 pieces of cigarette are provided in the close vicinity thereto. Vacuum suction mouths $V_1$, $V_2$, $V_3$, $V_4$, $V_5$ and $V_6$ are opened up in said arcuate supporting grooves $U_1$ through $U_6$. Said vacuum suction mouths $V_1$ through $V_6$ are communicated with openings $V_1''$, $V_2''$, $V_3''$, $V_4''$, $V_5$ and $V_6''$ formed on the side of the intermediate cigarette receiving plate 30 through communication passages $V_1'$, $V_2'$, $V_3'$, $V_4'$, $V_5'$ and $V_6'$.

On the other end of the top cigarette receiving suction plate 31, arcuate supporting grooves $W_1$, $W_2$, $W_3$, $W_4$, $W_5$, $W_6$, $W_7$ for the 7 pieces of cigarette are provided in the close vicinity thereto. Vacuum suction mouths $X_1$, $X_2$, $X_3$, $X_4$, $X_5$, $X_6$ and $X_7$ are opened up in said arcuate supporting grooves $W_1$ through $W_7$. Said vacuum suction mouths $X_1$ through $X_7$ are communicated with openings $X_1$, $X_2$, $X_3$, $X_4$, $X_5$, $X_6$ and $X_7$ formed on the side of said top cigarette receiving suction plate 31 through communication passages $X_1'$, $X_2'$, $X_3'$, $X_4'$, $X_5'$, $X_6'$ and $X_7'$.

A passage regulating plate 45 positioned between the fan-shaped air control ring 32 and the bottom cigarette receiving suction plate 29 is provided with communication slots $l_1$, $l_2$, $l_3$, $l_4$, $l_5$, $l_6$ and $l_7$ for the openings $T_1''$ through $T_7''$ of the bottom cigarette receiving suction plate 29, communication slots $m_1$, $m_2$, $m_3$, $m_4$, $m_5$ and $m_6$ for the openings $V_1''$ through $V_6''$ of the intermediate cigarette receiving suction plate 30 and communication slots $n_1$, $n_2$, $n_3$, $n_4$, $n_5$, $n_6$ and $n_7$ for the openings $X_1''$ through $X_7''$ of the top cigarette receiving suction plate 31.

The bottom cigarette receiving suction plate 29 is formed of communication slots $m_1'$ through $m_6'$, $n_1'$ through $n_7'$ for the intermediate and the top cigarette receiving suction plates 30 and 31, while the intermediate cigarette receiving suction plate 30 is formed with communication slots $n_1''$ through $n_7''$ for the top cigarette receiving suction plate 31.

The respective communication slots $l_1$ through $l_7$, $m_1$ through $m_6$, $n_1$ through $n_7$, $m_1'$ through $m_6'$, $n_1'$through $n_7'$ and $n_1''$ through $n_7''$ are formed in the range of slots which can correspond to the moving amount of the respective receiving suction plates 29, 30 and 31.

The air control ring 32 is formed of vacuum suction grooves and pressurized air supply mouths basically in the same manner as the afore-mentioned air control ring 22 of the arranging drums $C_1$, $C_2$ and $C_3$. Vacuum suction and pressurized air are sent from the air passage regulating plate 45 to the vacuum suction mouths $T_1$ through $T_7$, $V_1$ through $V_6$ and $X_1$ through $X_7$ of the respective receiving suction plates 29, 30 and 31 through the communication slots $l_1$ through $l_7$, $m_1$ through $m_6$ and $n_1$ through $n_7$.

The arcuate supporting grooves $U_1$ through $U_6$ in the intermediate cigarette receiving suction plate 30 are arranged in such a manner as to be a half way slided with respect to the arcuate supporting grooves $S_1$ through $S_7$ and $W_1$ through $W_7$ of the bottom and the top cigarette receiving suction plates 29 and 30 in the circumferential direction thereof.

With the above constitution, when the stacking drum D is rotated, the respective receiving suction plates 29, 30 and 31 approach to the arranging drums $C_1$, $C_2$ and $C_3$ at the outermost peripheral position in the stacking portion D'. The respective arcuate supporting grooves $S_1$ through $S_7$, $U_1$ through $U_6$ and $W_1$ through $W_7$ are brought to be in opposite relation with the arcuate supporting grooves $P_1$ through $P_7$ and $P_1$ through $P_6$ to form a cigarette accommodation space of a genuine circular configuration. The arcuate supporting grooves $S_1$ through $S_7$ for the bottom cigarette receiving suction plate 29 receive the 7 pieces of cigarette groups forced to move by 40 mm from the regular position from the arranging drum $C_1$ and the vacuum suction mouths $T_1$ through $T_7$ absorb and hold the 7 pieces of cigarette groups. After receiving and maintaining the cigarette groups $R_1$, the bottom cigarette receiving suction plate 27 is lowered by 7 mm and entered completely into the supporting metal 28' in order to prepare to receive the intermediate cigarette groups $R_2$.

Nextly, the stacking drum D piles up the 6 pieces of cigarette groups $R_2$ forced to move by 20 mm from the regular position from the arranging drum D upon the cigarette groups $R_1$ and at the same time the extended end portion by 20 mm is received by the arcuate supporting grooves $U_1$ through $U_6$ of the intermediate cigarette receiving suction plate 30 and absorbed and held by the vacuum suction mouths $V_1$ through $V_6$. In this state, the bottom and the intermadiate cigarette receiving suction plates 29 and 30 are lowered together by 7 mm and entered completely into the supporting metal 28' in order to prepare to receive the top cigarette groups $R_3$.

Thereafter, the stacking drum D piles up the 7 pieces of cigarette groups $R_3$ upon the cigarette groups $R_2$ and at the same time the extended end portion by 20 mm is received by the arcuate supporting grooves $W_1$ through $W_7$ of the top cigarette receiving suction plate 31, and absorbed and held by the vacuum suction mouths $X_1$ through $X_7$. In this state, the respective cigarette receiving plates 29, 30 and 31 are lowered by 4 mm together with the stacking cigarette groups $R_1$, $R_2$ and $R_3$ and entered completely into the supporting metal 28'. Then, the succeeding compression process starts. In the foregoing, since the delivering and receiving peripheral speeds are same for all of the respective rows of cigarette groups, the cigarette groups can be piled up in an orderly manner in the regular position As apparent from the foregoing description, according to the present invention, since the receiving roller directly delivers cigarette pieces one by one to the arcuate supporting grooves on the arranging drum, even if there should be deformed cigarette pieces due to uneven filling amount of cigarette leaves, the cigarette pieces can be arranged in an orderly manner, and furthermore, a predetermined number of cigarette pieces can be arranged in the thoroughly intimately contacted state with respect to each other, without hurting the cigarette pieces. The foregoing together with the cigarette supply system through plural passages enhance the high speed arrangement, thus achieving much higher productivity.

What is claimed is:

1. A cigarette arranging apparatus for packing a plurality of loose cigarettes into discrete groups containing a predetermined quantity of cigarettes comprising:

an arranging drum having a plurality of arcuate grooves formed in the periphery thereof, said grooves extending in the axial direction of the drum in intimate contact with each other in the circumferential direction; and a plurality of cigarette receiving rollers mounted in close proximity to the upper outer periphery of said arranging drum, said cigarette receiving rollers corresponding in number to that of said arcuate grooves, said cigarette receiving rollers being arranged each to receive one piece of cigarette out of said plurality of cigarettes, said arranging drum and said cigarette receiving rollers being rotated in the reverse directions, said plurality of cigarette receiving rollers including a leading roller and successively trailing rollers being respectively arranged to supply cigarettes into said plurality of arcuate supporting grooves, respectively, from the leading groove and thereafter successively into the trailing grooves without changing the motion speed thereof, thereby forming a group of cigarette pieces in intimate contact with each other.

2. A cigarette arranging apparatus according to claim 1, wherein said cigarette receiving rollers are each provided with a cigarette dropping passage defined by partition panels, said passage being provided at the other end with respect to the roller with a cigarette agitator roller in order to facilitate the smooth dropping of cigarette pieces into each passage.

3. A cigarette arranging apparatus according to claim 1, wherein said cigarette receiving rollers are each provided with an air control ring urgedly contacted to the outside thereof by a spring.

4. A cigarette arranging apparatus according to claim 1, wherein each of aaid receiving rollers includes a suction mouth opened up in the side face thereof through communication passages.

5. A cigarette arranging apparatus according to claim 1, wherein said arranging drum is provided with an air control ring urgedly contacted to a side face thereof by a spring, said air control ring communicating with a vacuum suction passage as well as a pressurized air supply pipe.

6. A cigarette arranging apparatus for packing a plurality of loose cigarettes into discrete groups containing a predetermined quantity of cigarettes, comprising:

a stacking drum;

a plurality of arranging drums provided in close proximity to the upper outer periphery of said stacking drum and each adapted to convey a group of cigarettes into said stacking drum, each of said arranging drums including a plurality of arcuate grooves formed in the periphery thereof, said grooves extending in the axial direction of the associated arranging drum in intimate contact with each other in the circumferential direction; and a plurality of cigarette receiving rollers mounted in close proximity to the upper outer periphery of each of said arranging drums, said cigarette receiving rollers corresponding in number to that of said arcuate grooves, said cigarette receiving rollers being arranged each to receive one piece of cigarette out of said plurality of cigarette pieces, said arranging drums and said cigarette receiving rollers being rotated in reverse directions, said plurality of cigarette receiving rollers including a leading roller and successively trailing roller being respectively arranged to supply cigarette pieces into said plurality of arcuate supporting grooves, respectively, from the leading groove and thereafter successively into the trailing grooves without changing the motion speed thereof, thereby forming a group of cigarette pieces in intimate contact with each other.

7. A cigarette arranging apparatus according to claim 6, wherein said arranging drums include a first drum for arranging 7 pieces of cigarette, a second drum for arranging 6 pieces of cigarette and a third drum for arranging 7 pieces of cigarette.

8. A cigarette arranging apparatus according to claim 7, wherein said first, second and third drums are respectively provided with 7 cigarette receiving rollers, 6 cigarette receiving rollers and 7 cigarette receiving rollers in close proximity to the upper outer periphery of each of said first, second and third drums.

9. A cigarette arranging apparatus according to claim 6, wherein the peripheral speeds of said receiving rollers, arranging drums and stacking drum are synchronized with respect to each other.

10. A cigarette arranging apparatus according to claim 6, wherein said stacking drum is comprised of a cylindrical portion and an annular plate portion.

11. A cigarette arranging apparatus according to claim 10, wherein said annular plate portion includes a pair of L-shaped slide guide members fixedly secured thereto in such a manner as to form an accommodation pocket.

12. A cigarette arranging apparatus according to claim 11, wherein said slide guide members include cigarette suction plates.

13. A cigarette arranging apparatus according to claim 11, wherein said slide guide members are fixed with an air passage regulating plate at the open ends thereof.

14. A cigarette arranging apparatus for packing a plurality of loose cigarettes into discrete groups containing a predetermined quantity of cigarettes, comprising:

an arranging drum having a plurality of arcuate grooves formed in the periphery thereof, said grooves extending in the axial direction of the drum in intimate contact with each other in the circumferential direction; and a plurality of cigarette receiving rollers mounted in closed proximity to the upper outer periphery of said arranging drum, said cigarette receiving rollers corresponding in number to that of said arcuate grooves, said cigarette receiving rollers being arranged each to receive one piece of cigarette out of said plurality of cigarettes, said arranging drum and said cigarette receiving rollers being rotated in the reverse directions, said plurality of cigarette receiving rollers including a leading roller and successively trailing rollers being respectively arranged to supply cigarettes into said plurality of arcuate supporting grooves, respectively, from the leading groove and thereafter successively into the trailing grooves without changing the motion speed thereof, thereby forming a group of cigarette pieces in intimate contact with each other, wherein each of said receiving rollers includes a pair of cigarette supporting members having an arcuate supporting plate, a bottom portion of said arcuate supporting plate being formed slightly higher than the outer periphery of the cigarette receiving roller to define a space between a cigarette piece and the roller in order to minimize vibration of the cigarette.

15. A cigarette arranging apparatus for packing a plurality of loose cigarettes into discrete groups containing a predetermined quantity of cigarettes, comprising:

an arranging drum having a plurality of arcuate grooves formed in the periphery thereof, said grooves extending in the axial direction of the drum in intimate contact with each other in the circumferential direction; and a plurality of cigarette receiving rollers mounted in close proximity to the upper outer periphery of said arranging drum, said cigarette receiving rollers corresponding in number to that of said arcuate grooves, said cigarette receiving rollers being arranged each to receive one piece of cigarette out of said plurality of cigarettes, said arranging drum and said cigarette receiving rollers being rotated in the reverse directions, said plurality of cigarette receiving rollers including a leading roller and successively trailing rollers being respectively arranged to supply cigarettes into said plurality of arcuate supporting grooves, respectively, from the leading groove and thereafter successively into the trailing grooves without changing the motion speed thereof, thereby forming group of cigarette pieces in intimate contact with each other, wherein said cigarette receiving rollers are each provided with a cigarette dropping passage defined by partition by partition panels, said passage being provided at the other end with respect to the roller with a cigarette agitator roller in order to facilitate the smooth dropping of cigarette pieces into each passage, and wherein each of said receiving rollers includes a cigarette transfer knob having an arcuate abutting plane on the outer periphery thereof, said knob being arranged to direct a cigarette piece dropped through the cigarette dropping passage onto the associated receiving roller in the direction of rotation of the receiving roller.

16. The apparatus according to claim 15, wherein the height of said knob is less than the diameter of said cigarette, said cigarette thereby projecting radially outward above said knob.

* * * * *